US006035783A

United States Patent [19]

Cho

[11] Patent Number: 6,035,783

[45] Date of Patent: Mar. 14, 2000

[54] HIGH PERFORMANCE FUZE

[75] Inventor: Sung H. Cho, Mt. Pocono, Pa.

[73] Assignee: The United States of America as represented by the Secretary of the Army, Washington, D.C.

[21] Appl. No.: 09/040,248

[22] Filed: Mar. 9, 1998

Related U.S. Application Data

[60] Provisional application No. 60/043,103, Apr. 17, 1997.

[51] Int. Cl.[7] ..... F42C 15/26

[52] U.S. Cl. ..... 102/235; 102/244; 102/254; 102/273

[58] Field of Search ..... 102/231, 233, 102/234, 235, 236, 237, 239, 244, 245, 254, 272, 273

[56] References Cited

U.S. PATENT DOCUMENTS

| | | | |
|---|---|---|---|
| 1,547,598 | 7/1925 | Lukens et al. | 102/235 |
| 1,547,599 | 7/1925 | Lukens | 102/235 |
| 1,689,470 | 10/1928 | Adelman | 102/235 |
| 2,882,825 | 4/1959 | Losfeld et al. | 102/236 |
| 3,264,995 | 8/1966 | Libby et al. | 102/245 |
| 3,326,132 | 6/1967 | Tham | 102/236 |

OTHER PUBLICATIONS

Technical Report ARAED–TR–96021, Title: 40–mm M549A1 PIBD Fuze Proposed Self–Destruct Concept—Sung H. Cho Aug. 1996.

Sung Cho, "A High Performance Concept for 40mm M549A1 PIBD Fuse", ADPA 41st Annual Fuze Conference, Apr. 14, 1997.

*Primary Examiner*—Harold J. Tudor

*Attorney, Agent, or Firm*—John Moran; Michael Sachs

[57] ABSTRACT

A fuze device for use with a detonator on munitions. A cup and ogive assembly includes an ogive post for aft axial movement upon impact of the device and activation of a spitback lead on the cup. An ogive post activates a first firing pin when the ogive is crushed. A first safe and arm (S&A) device is aligned with the centerplate assembly to provide a first detonator in both the safe and the armed condition by movement of a rotor. A second firing pin is positioned below the first S&A device. It has a blowthrough hole for alignment of the first detonator with the spitback lead. A second S&A device is below the first S&A device, and has a second detonator and rotor that rotates during spin to an armed position to expose the second detonator to the second firing pin. The second rotor is sized and shaped to always permit alignment of the first detonator with the spitback lead. Upon impact on the ogive after launch, the ogive post initiates the first firing pin to detonate the first detonator and the rotor in the second safe and arm device impacts on the second firing pin to detonate the second detonator, such that detonation of either detonators causes the spitback lead to initiate.

4 Claims, 1 Drawing Sheet

HIGH PERFORMANCE FUZE

RELATED APPLICATION

This application claims benefit of the Apr. 17, 1997 filing date of prior provisional application Ser. No. 60/043,103, the entire file wrapper contents of which application are hereby incorporated by reference as though fully set forth here at length.

The invention described herein may be manufactured, used, and licensed by or for the U.S. Government for U.S. Governmental purposes.

FIELD OF THE INVENTION

The present invention relates to fuzes for projectiles. More particularly the invention relates to a fuze that markedly reduces duds and increases fuze functional reliability.

BACKGROUND OF THE INVENTION

The dangerous task of battlefield clean up after battles has demonstrated the need for self-destruct devices in fuzes. Reducing duds—unexploded projectiles—is needed to eliminate a potential hazard condition in the field and minimize the efforts of Explosive Ordnance Disposal personnel needed to clean up the field. This has become an important focus in fuze design.

Reducing duds in the field may be accomplished by increasing or maximizing fuze reliability or by adding a self-destruct feature which causes self initiation of the main charge when the primary activation system fails.

The dud problem of mechanical fuzes has long been an issue in military operations. Virtually all fuzes have a built-in failure rate to some extent. Prior attempts to reduce duds or unexploded projectiles remaining in a field include the addition of a self-sterilization/neutralization device to the fuze. The prior art method causes a high order functioning when the fuze is armed, to produce the desired self-destruct event. If the fuze is not armed, functioning the primary explosive will reduce the hazard but will still leave an unexploded round in the field. This type of device, therefore, still requires Explosive Ordnance Disposal personnel to clean up the field and still renders a potential hazardous condition in the field itself. Combat effectiveness is not improved by this prior art device, but rather, adds a significant cost increase to the fuze.

It would be of great advantage if a fuze could be developed that would improve combat effectiveness so that rounds would function as intended rather than with a self-destruct mode that offers limited or no effectiveness.

Accordingly, one object of this invention is to provide a fuze that maximizes reliability of the fuze to over 99.9%, statistically.

Another object of this invention is to provide a fuze that avoids the need for a self-destruct mechanism.

A specific object of this invention is to provide a fuze that utilizes existing mechanical design to maintain manufacturing and cost advantages while substantially improving effectiveness and reliability.

Other objects will appear hereinafter.

SUMMARY OF THE INVENTION

It has now been discovered that the above and other objects of the present invention may be accomplished in the following manner. The present invention may be used in the 40 mm M549A1 fuze, for instance.

The external fuze includes a cup and ogive assembly. The ogive includes an internal ogive post for downward or aft axial displacement to activate the firing mechanism of the fuze upon impact of the target. The assembly of the cup and ogive forms an enclosure having a spitback lead on the aft part of the cup to thereby activate the remaining portion of the munitions.

Inside the ogive is a centerplate assembly operable as a mechanical firing sensor with a first firing pin. The assembly retracts the firing pin from the rotor upon launch and drives the firing pin into the detonator upon impact with the target. The centerplate assembly also includes an inertia ring which moves aft during launch to cooperatively retract the firing pin from the rotor and activates the firing pin on impact.

The fuze includes a pair of safe and arm devices axially aligned below the centerplate assembly. Both safe and arm devices have a fuze detonator, such as an M55 detonator, and include a rotor having two safety locks removable by rotational velocity upon launch. The rotor rotates during spin to an armed position to expose the detonator to a firing pin. Before firing, the rotors are locked in a safe position by a setback pin that moves aft during launch to permit the rotor to move to an arm position.

A second firing pin is positioned below the first safe and arm device and has an anti-creep spring. This second pin has a blowthrough hole for alignment of the first detonator with the spitback lead. The second safe and arm device is axially aligned below the first safe and arm device. The second rotor is sized and shaped to always permit alignment of the first detonator with the spitback lead.

The device operates on impact to drive the ogive post into the first firing pin to detonate the first detonator. The rotor in the second safe and arm device impacts on the second firing pin to detonate the second detonator. Detonation of either detonator causes the spitback lead to initiate.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
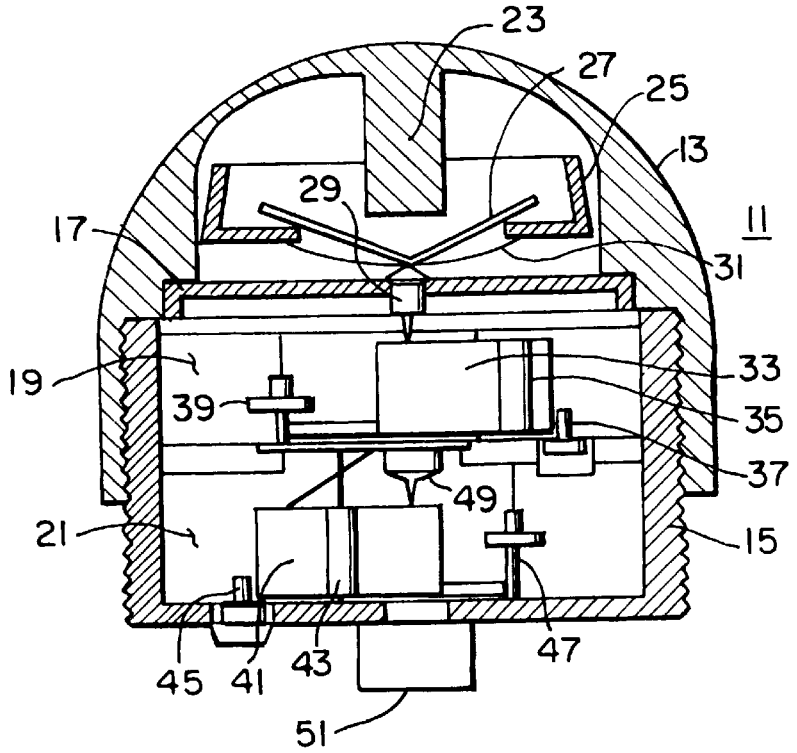
FIG. 1 is a sectional, side elevational, schematic view of the fuze device of the present invention.

The present invention has many advantages over the prior art. Referring to FIG. 1, the present invention comprises a fuze 11 having an ogive 13 surrounding the top of a cup 15. A centerplate assembly 17 is positioned inside ogive 13 and above cup 15. Below centerplate assembly 17 is a first safe and arm (S&A) mechanism 19 that is positioned above a second S&A mechanism 21.

Inside ogive 13 is an axially centered ogive post 23 that engages firing pin 29. Axially centered firing pin 29 is mounted in centerplate assembly 17 by springs 31 that in turn are attached to brackets 27. Inertia ring 25 is held by brackets 27.

First S&A mechanism 19 includes rotor 33 and an M55 detonator 35 next to setback pin 37. Runaway escapement 39 is also part of first S&A mechanism 19. Similarly, second S&A mechanism 21 includes a similar rotor 41, M55 detonator 43, setback pin 45 and runaway escapement 47, again noting that S&A mechanism 19 is above S&A mechanism 21 in the axial direction toward the main device, not shown. A second S&A mechanism firing pin 49 is aligned like first firing pin 29. M55 spitback lead 51 is positioned as shown in FIG. 1.

Figure 2:
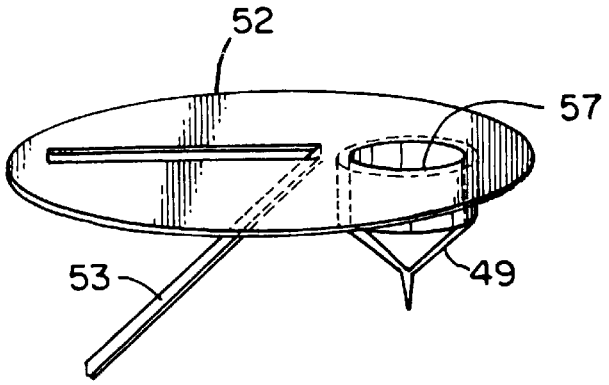
FIG. 2 is a perspective, schematic view of one component of the device shown in FIG. 1.
Figure 3:
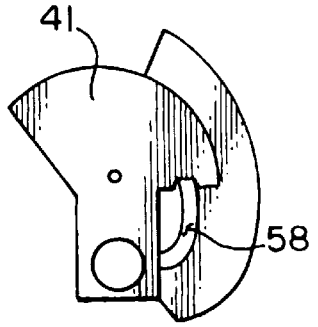
FIG. 3 is a perspective, schematic view of another component of the device shown in FIG. 1.

Turning now to FIGS. 2 and 3, details of firing pin 49 and rotor 41 are shown as used in second S&A mechanism 21. Firing pin 49 is mounted on a flat plate 52 including anti-creep spring 53. Rotor 41 cooperates with firing pin 49 as described below and is configured to avoid blocking a path from M55 detonator 35.

Prior to launch, rotor 33 is locked in the safe position by setback pin 37 and two spin locks, not shown. Upon launch, acceleration drives setback pin 37 back, removing the first safety lock on rotor 33, which of course contains an M55 detonator 35.

Acceleration also drives an inertia ring 25 in the centerplate assembly 17 aft, allowing the firing pin springs 31 to retract the firing pin 29 from rotor 33. When the proper rotational velocity is reached, the two spin locks (not shown) retract removing the last safety locks on rotor 33.

Rotor 33, driven by spin, begins to rotate to the armed position, but this rotation is delayed by runaway escapement 39. Centrifugal force acting on the three brackets 27 in centerplate assembly 17 keeps the inertia ring 25 in the aft position. After rotor 33 has fully rotated to the armed position, with an arming delay of 100 to 150 ms, a rotor lock ball (not shown) is driven out by centrifugal force and locks rotor 33 with detonator 35 positioned under firing pin 29.

The second S&A mechanism 21 is identical to first S&A mechanism 19, so that all the safety locks will be removed simultaneously with those of first S&A mechanism 19. In this second S&A mechanism 21, M55 detonator 43 will be fired by using a firing pin containing an anti-creep pin 53. Firing pin 49, shown in FIG. 2, includes blow through hole 57, and is a one-piece part assembled on the top of second S&A mechanism 21. Anti-creep spring 53, is built-in to the firing pin assembly 49 to prevent rotor 41 from unintentionally moving forward in flight.

After firing, the fuze device 11 moves from the assembled and safe position shown in FIG. 1 as follows. On setback and removal of the first safety lock, setback pins 37 and 45, brackets 27 are straightened out to push firing pin 29 forward in conjunction with firing pin spring 31. Rotational velocity imparted by spin retracts two spin locks (not shown) on both rotors 33 and 41. Rotational velocity keeps brackets 27 in flat postion and rotates both rotors to the armed position with M55 detonators 35 and 43 axially aligned with the firing pins 29 and 49, respectively.

On impact, the first S&A mechanism 19, if the fuze functions in a direct impact mode, ogive 13 will be crushed and drive internal ogive post 23 into firing pin 29 to initiate M55 detonator 35. The second S&A mechanism 21 rotor 41 will slide forward on impact such that the M55 detonator 43 is driven into firing pin 49. This happens regardless of impact modes, either direct or graze impact being sufficient to accomplish this.

On impact, therefore, one of three possible modes of fuze function will occur. Because of its design, the spitback lead 51 will be initiated in all three cases and the fuze will have fulfilled its mission In Case One, both S&A mechanisms 19 and 21 are in the fully armed position and centerplate assembly 17 will function properly. Centerplate assembly 17 will be activated such that firing pin 29 will stab detonator 35 in first S&A mechanism 19. At the same time the rotor 41 in second S&A mechanism 21 will slide toward firing pin 49 and detonator 43 will initiate the spitback lead 51 and the fuze will have fulfilled its mission.

In Case Two, either the first S&A mechanism 19 fails to arm or the centerplate assembly 17 fails to function, but the second S&A mechanism 21 arms. Rotor 41 in second S&A mechanism 21 will slide toward firing pin 49 and detonator 43 will be initiated, which, in turn, fires spitback lead 51.

In Case Three, S&A mechanism 21 fails to arm while first S&A mechanism 19 is in the fully armed position and centerplate assembly 17 functions properly. That centerplate assembly 17 will be activated such that firing pin 29 stabs detonator 35 in S&A mechanism 19, which in turn initiates spitback lead 51 through the blow through hole 57 in firing pin 49 in second S&A mechanism 21. Note that rotor 41 has a kidney shaped slot 58 such that the output energy from the first S&A mechanism 19 can initiate spitback lead 51 regardless of the position of rotor 41 in second S&A mechanism 21.

While particular embodiments of the present invention have been illustrated and described herein, it is not intended that these illustrations and descriptions limit the invention. Changes and modifications may be made herein without departing from the scope and spirit of the following claims.

I claim:

1. A fuze device for use with a detonator, comprising:

a cup and ogive assembly having an axis with the ogive including an ogive post for rearward axial movement upon impact of said device in the forward direction of travel, said assembly forming an enclosure for axial attachment to a spitback lead on said cup;

a centerplate assembly operable as a mechanical firing sensor with a first firing pin and positioned within said ogive;

a first safe and arm device axially aligned below said centerplate assembly, said first safe and arm device including a first detonator and a first rotor having a first safety lock setback pin allowing said first rotor to rotate to an armed position by exposing said first detonator to said first firing pin;

a second firing pin containing an anti-creep spring positioned below said first safe and arm device, said second pin having a blowthrough hole for alignment of said first detonator with said spitback lead;

a second safe and arm device axially aligned below said first safe and arm device, said second safe and arm device including a second detonator and a second rotor having a second safety lock setback pin removable by acceleration upon launch allowing said second rotor to rotate to an armed position by exposing said second detonator to said second firing pin, said second rotor containing a kidney shaped slot thereby to always permit alignment of said first detonator with said spitback lead;

whereby impact on said ogive after launch causes said ogive post to initiate said first firing pin to detonate said first detonator and said second rotor in said second safe and arm device impacts on said second firing pin to detonate said second detonator, such that detonation of either the first fuze detonator or the second fuze detonator causes said spitback lead to initiate.

2. The device of claim 1, wherein said centerplate assembly operably contains said first firing pin and positions to move said first firing pin from said first rotor to an armed position.

3. The device of claim 2, which further includes brackets and an inertia ring means in said ogive and attached to said centerplate assembly to move aft during launch to cooperatively move said first firing pin.

4. The device of claim 3, wherein said inertia ring means maintains its aft position by centrifugal force during flight in conjunction with said brackets.

* * * * *